US006421862B2

(12) United States Patent
Lesco et al.

(10) Patent No.: US 6,421,862 B2
(45) Date of Patent: Jul. 23, 2002

(54) CARPET EXTRACTOR FLUID SUPPLY SYSTEM

(75) Inventors: Erik D. Lesco, Delroy; David G. Mueller, Canton; Kevin L. Thomas, North Canton, all of OH (US)

(73) Assignee: The Hoover Company, North Canton, OH (US)

( * ) Notice: Subject to any disclaimer, the term of this patent is extended or adjusted under 35 U.S.C. 154(b) by 0 days.

(21) Appl. No.: 09/843,361

(22) Filed: Apr. 25, 2001

Related U.S. Application Data

(62) Division of application No. 09/327,091, filed on Jun. 4, 1999, now Pat. No. 6,247,202.

(51) Int. Cl.[7] ..... D06B 1/02; B08B 3/02

(52) U.S. Cl. ..... 8/158

(58) Field of Search ..... 15/50.1, 320, 321, 15/410, DIG. 10; 8/158, 137; 134/21

(56) References Cited

U.S. PATENT DOCUMENTS

| | | | | | |
|---|---|---|---|---|---|
| 1,204,478 | A | | 11/1916 | Noakes et al. | 15/320 |
| 1,233,822 | A | | 7/1917 | Stewart | 362/372 |
| 1,480,662 | A | | 1/1924 | Caine | 15/50.1 |
| 3,101,505 | A | * | 8/1963 | Belicka et al. | 15/320 |
| 3,444,577 | A | | 5/1969 | Koland | 15/50.1 |
| 3,533,120 | A | | 10/1970 | De Mercado | 15/50.1 |
| 4,154,578 | A | * | 5/1979 | Bane | 8/158 X |
| 4,558,823 | A | | 12/1985 | Groth | 239/413 |
| 4,570,856 | A | | 2/1986 | Groth et al. | 239/310 |
| 4,575,007 | A | | 3/1986 | Groth et al. | 239/310 |
| 4,956,891 | A | * | 9/1990 | Wulff | 15/320 |
| 5,493,752 | A | * | 2/1996 | Crouser et al. | 15/320 |
| 5,500,977 | A | | 3/1996 | McAllise et al. | 15/320 |
| 5,867,857 | A | | 2/1999 | Crouser et al. | 15/50.1 |
| 5,891,198 | A | * | 4/1999 | Pearlstein | 8/158 |
| 5,901,406 | A | * | 5/1999 | Mueller et al. | 15/320 |
| 6,009,593 | A | | 1/2000 | Crouser et al. | 15/320 |
| 6,016,973 | A | * | 1/2000 | Thimpson et al. | 15/320 |

* cited by examiner

*Primary Examiner*—Philip Coe
(74) *Attorney, Agent, or Firm*—A. Burgess Lowe; Brett A. Schenck

(57) ABSTRACT

A novel carpet extractor is disclosed having a first cleaning liquid conduit that communicates a supply reservoir with a cleaning liquid distributor via a first valve and a second cleaning liquid conduit that communicates the supply reservoir with the liquid distributor via a second valve. The first valve is actuated by a main trigger and the second valve is actuated by a surge button, both of which are conveniently located in the hand grip on the handle of the machine for propelling the machine over a floor surface. A first normal flow of cleaning liquid is obtained for normal cleaning by depressing the trigger and a second greater flow of cleaning liquid is obtained by depressing the button and the trigger simultaneously. A mechanism is preferably included that will open the first valve in the event an operator depresses only the surge button.

10 Claims, 9 Drawing Sheets

| |
|---|
| FIG-3A |
| FIG-3B |

CARPET EXTRACTOR FLUID SUPPLY SYSTEM

RELATED APPLICATION

This application is a divisional of U.S. patent application Ser. No. 09/327,091, filed Jun. 4, 1999, and now U.S. Pat. No. 6,247,202.

BACKGROUND OF THE INVENTION

1. Field of the Invention

The present invention pertains to a carpet extractor fluid supply system. More particularly, the present application pertains to such a fluid supply system that is capable of supplying fluid to a floor being cleaned at two different rates, namely a first normal flow rate for normal cleaning and a second higher flow rate for cleaning heavily soiled areas.

2. Background Information

It is known in the prior art to provide a carpet extractor with a fluid reservoir that communicates with a fluid distributor for distributing cleaning fluid upon a floor surface such as carpeting or bare floor. A valve is typically located between the fluid reservoir and the fluid distributor. The valve is actuated by a remote actuator, such as a manually actuated trigger located in the hand grip of the machine. Such an arrangement is illustrated in commonly owned U.S. Pat. Nos. 5,500,977 and 5,867,857. 1,204,478 issued to Naokes discloses a floor scrubbing machine that has a cleaning solution reservoir having two pipes communicating the reservoir to a floor distributor. Each of the two pipes has its own valve for independently supplying cleaning solution to the distributor.

In order to clean heavily soiled areas on carpeting, prior art devices have sought to provide a more concentrated mixture of cleaning detergent in water by employing mixing valves. U.S. Pat. No. 4,575,007 is an example of such a carpet extractor having a mixing valve for providing a first normal concentration of detergent in water for normal cleaning and a second higher concentration of detergent in water for cleaning high traffic or heavily soiled areas of carpeting.

Mixing valves are typically complicated, expensive, temperamental structures that often provide unreliable concentrations of cleaning solution. As a result, there is a need in the prior art for a simple, inexpensive manner of effectively cleaning high-traffic or heavily soiled areas of carpeting using a carpet extractor.

SUMMARY OF THE INVENTION

It is an object of the present invention to provide a simple, inexpensive fluid supply system that provides a first mode of operation for normal cleaning of carpeting and a second mode of operation for cleaning heavily soiled areas of carpeting It is a further object of the present invention to provide a cleaning solution distribution system having a first normal flow of cleaning solution for normal cleaning and a second heavier flow of cleaning solution for cleaning heavily soiled areas of carpeting.

Still a further object of the present invention is to providing a carpet extractor having a first valve that is opened for normal cleaning and a second valve that is opened simultaneously with the first valve to provide for a heavier flow of cleaning solution.

The foregoing and other objects of the present invention, that will be readily apparent from the following description and the attached drawings, are achieved in a preferred embodiment of the present invention by providing a first cleaning liquid conduit that communicates a supply reservoir with a cleaning liquid distributor via a first valve and a second cleaning liquid conduit that communicates the supply reservoir with the liquid distributor via a second valve. The first valve is actuated by a first manual actuation mechanism and a second valve is actuated by a second manual actuation mechanism, both of which are conveniently located in the hand grip on the handle of the machine for propelling the machine over a floor surface.

BRIEF DESCRIPTION OF THE DRAWINGS

The invention will now be described, by way of example, with reference to the attached drawings, of which.

DETAILED DESCRIPTION OF THE PREFERRED EMBODIMENT

Figure 1:
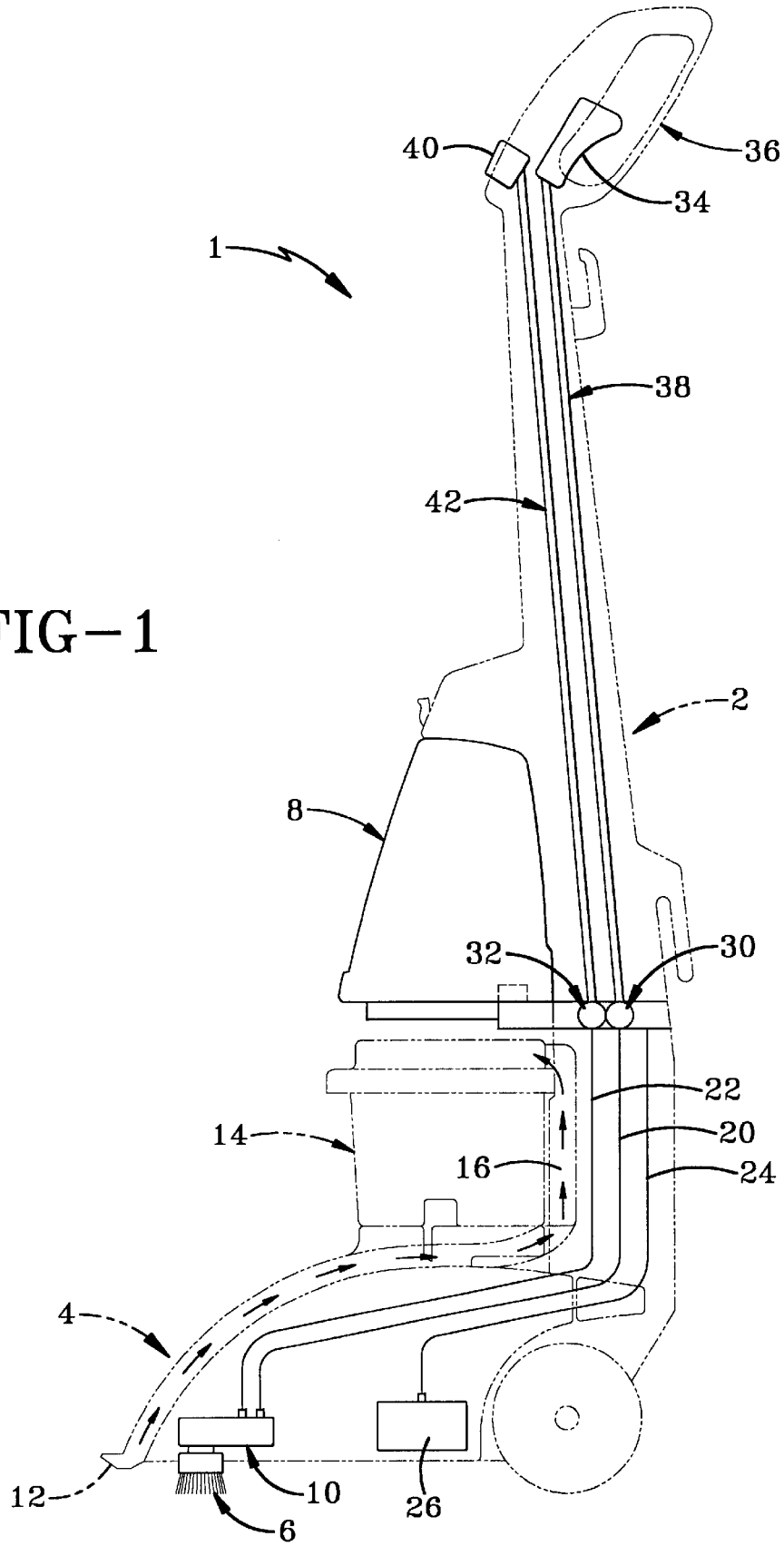
FIG. 1 is a diagrammatic side view of a carpet extractor incorporating a fluid distribution system according to the present invention.

In one form or preferred embodiment of the present invention, a fluid supply system is provided in an upright style carpet extractor 1 as diagrammatically illustrated in FIG. 1. Upright carpet extractors include a pivotal handle portion 2 for propelling a floor engaging portion or foot 4 over a floor. The foot preferably includes a plurality of rotating scrub brushes 6 for scrubbing the floor. Cleaning liquid is supplied from a cleaning liquid supply tank 8 on the handle to a cleaning liquid distributor 10. The cleaning liquid distributor evenly distributes the cleaning liquid to each of the rotary scrub brushes. The scrub brushes then spread the cleaning liquid onto the carpet (or bare floor), scrub the cleaning liquid into the carpet and dislodge embedded soil.

Soiled cleaning liquid is extracted from the carpet by a suction nozzle 12, which communicates with a recovery tank 14 via an air duct 16. A partial vacuum is created in the recovery tank by a motor fan assembly (not shown) that draws air from the recovery tank and exhausts the air to the external atmosphere in a well known, conventional manner. The recovery tank includes an air and liquid separator (not shown), as is understood by one of skill in the art, for separating liquid from the air entering the recovery tank and recovering the separated liquid in the tank. The air and liquid separator does not form a part of the present invention and is not described in detail herein.

The cleaning liquid supply tank 8 fluidly communicates with the cleaning liquid distributor 10 via a first 20 and a second 22 supply tube. A third supply tube 24 preferably provides a supply of cleaning liquid from the supply tank to a pump 26, diagrammatically illustrated in FIG. 1. The pump provides pressurized cleaning solution to a hand-held cleaning attachment (not shown). The pump and the hand-held cleaning attachment do not form a part of the present invention and are not described in further detail herein.

A suitable upright carpet extractor is disclosed in co-owned U.S. Pat. No. 5,500,977 and the preferred distributor and scrub brushes are substantially disclosed in commonly owned U.S. Pat. Nos. 5,867,857 and 6,009,593, the disclosures of all three of which are hereby incorporated herein as of reference.

A first valve 30 is located between the first supply tube 20 and the supply tank 8 and a second valve 32 is located between the second supply tube 22 and the supply tank. The first valve is actuated by a manually actuated main trigger 34 located in a hand-grip 36 for actuation by the index finger of an operator. The trigger actuates the first valve by way of a first actuating rod 38. A manually actuated thumb-button 40 is also located on the hand grip. The thumb-button is located for convenient actuation by an operator's thumb while grasping the hand grip. The thumb-button actuates the second valve by way of a second actuating rod 42.

Figures 2, 2A, 2B:
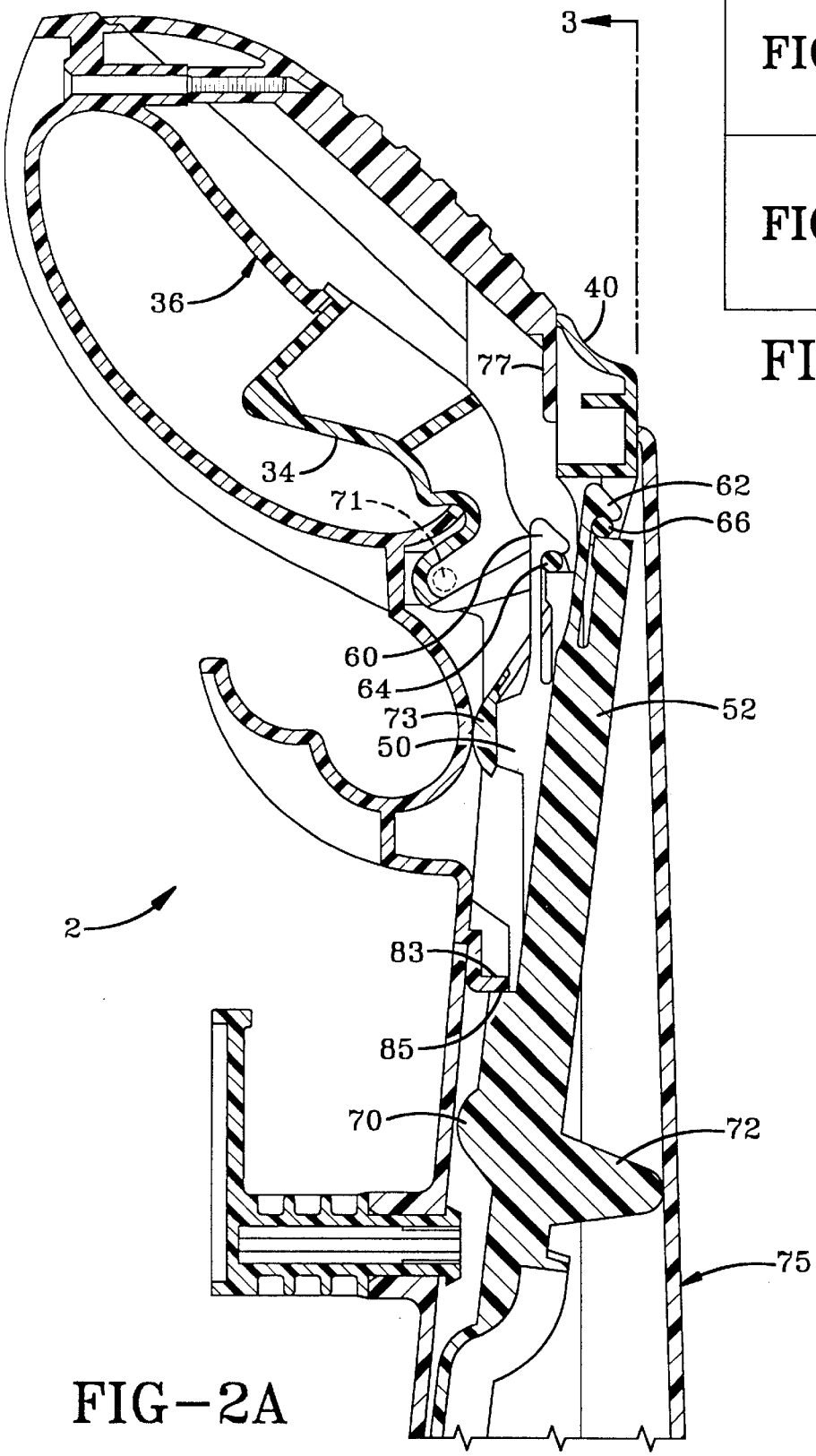
FIGS. 2A and 2B are a cross-sectional side view of an upper handle portion of a carpet extractor according to the present invention.
Figure 2B:
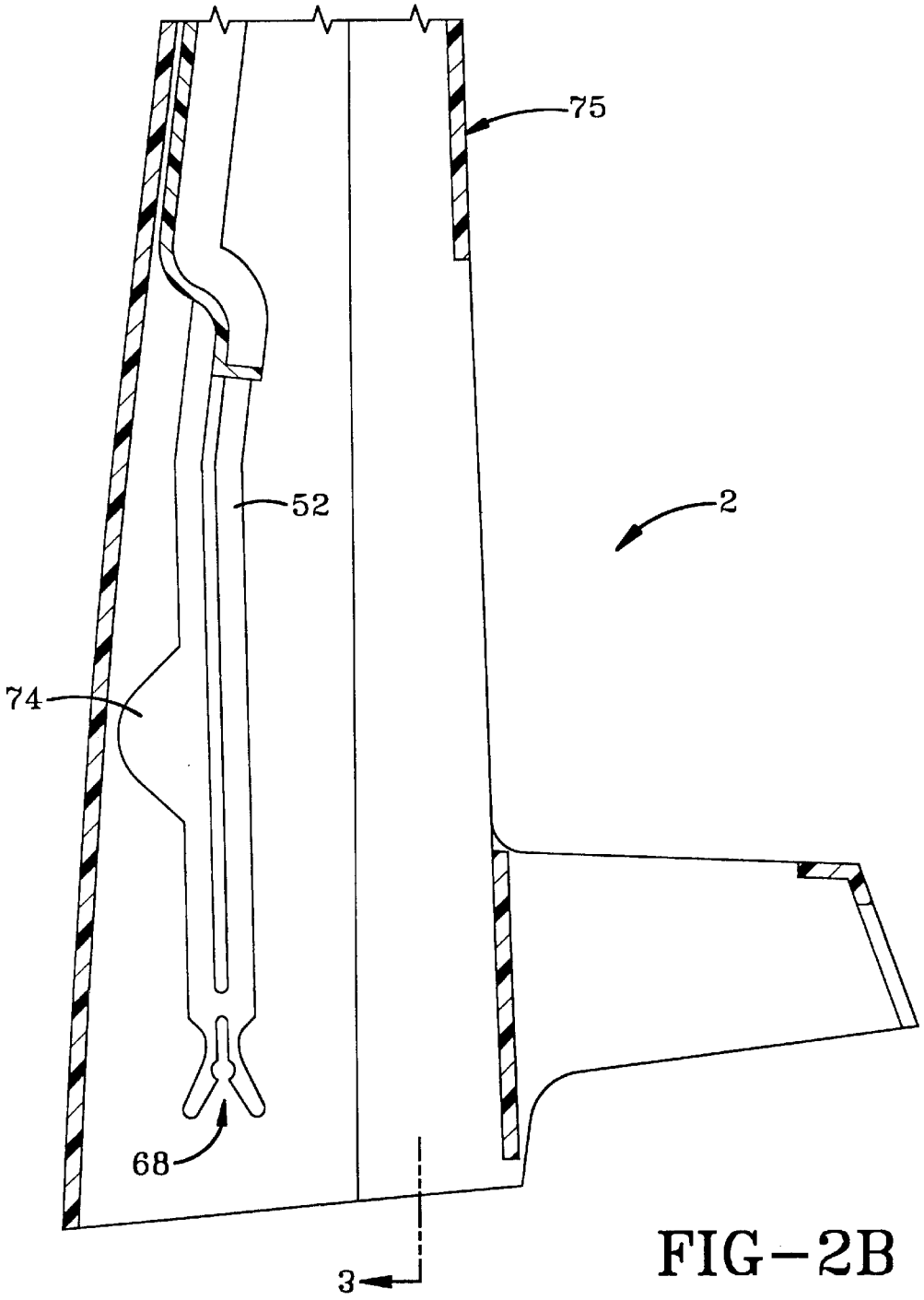
Figures 3, 3A:
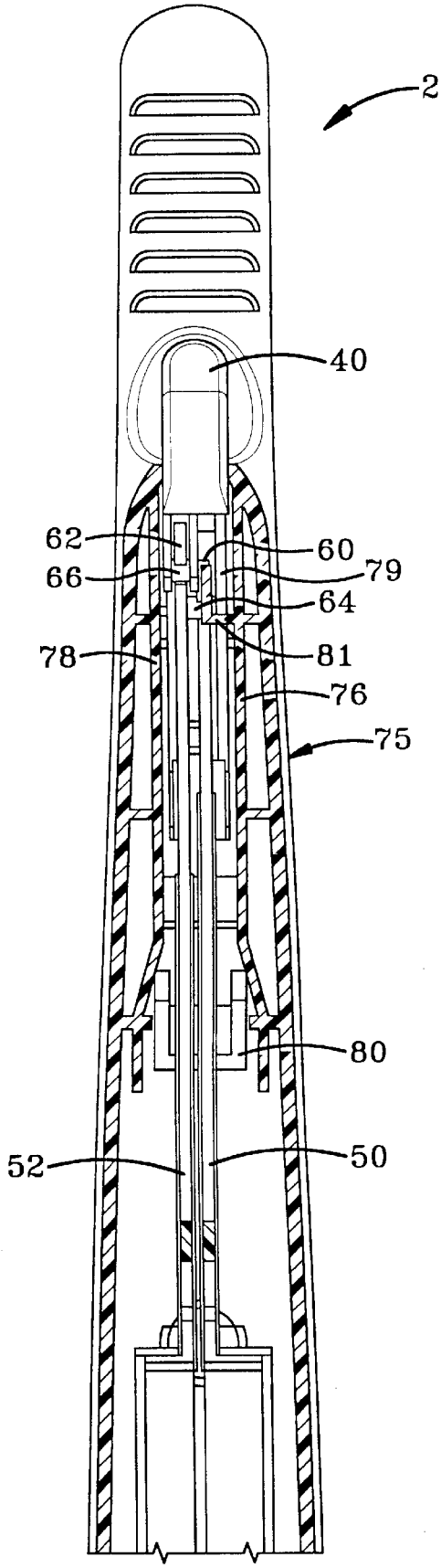
FIGS. 3A and 3B are a cross-sectional front view of the upper handle assembly taken along line 3—3 in FIG. 2.
Figure 3B:
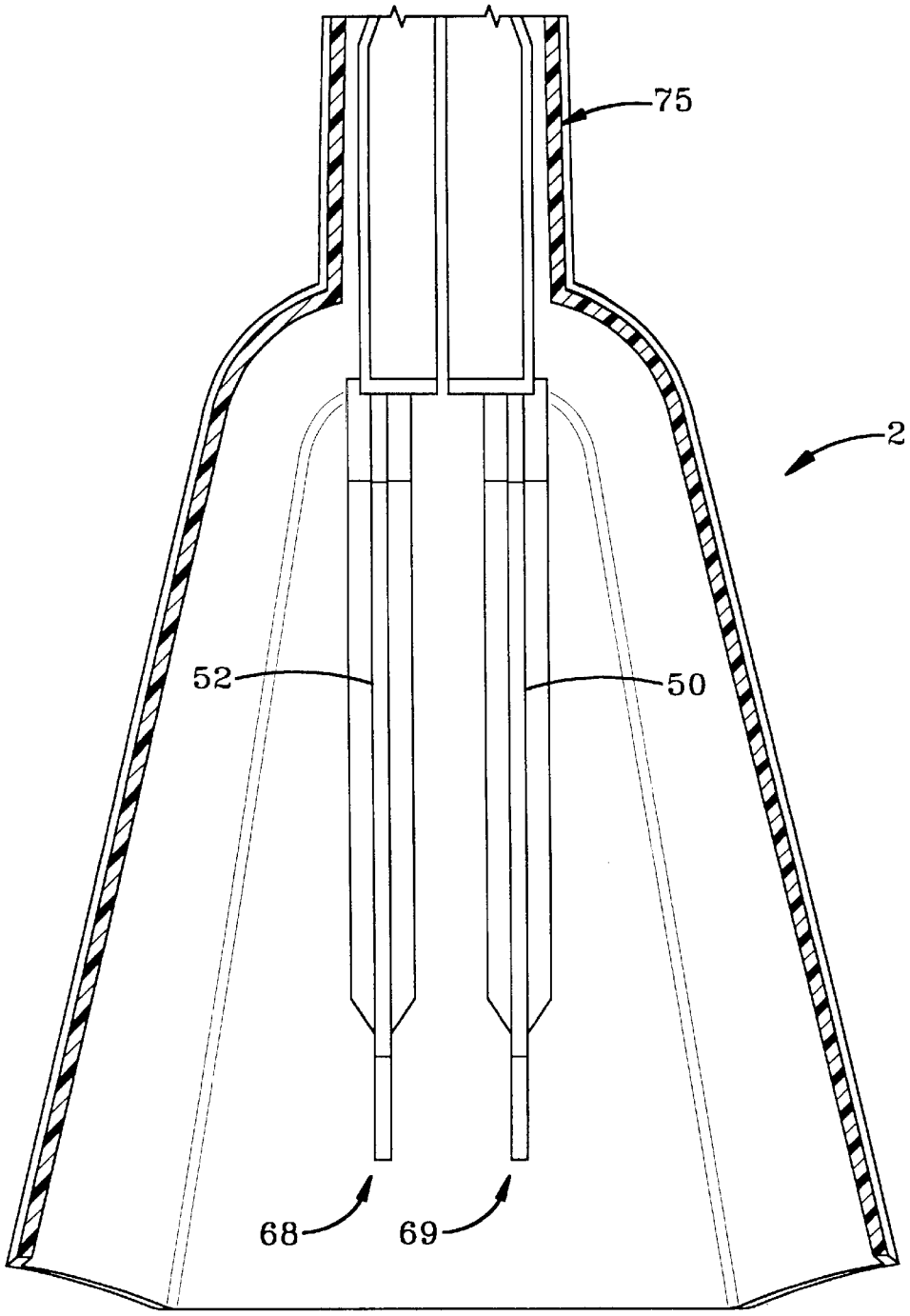
Figure 4:
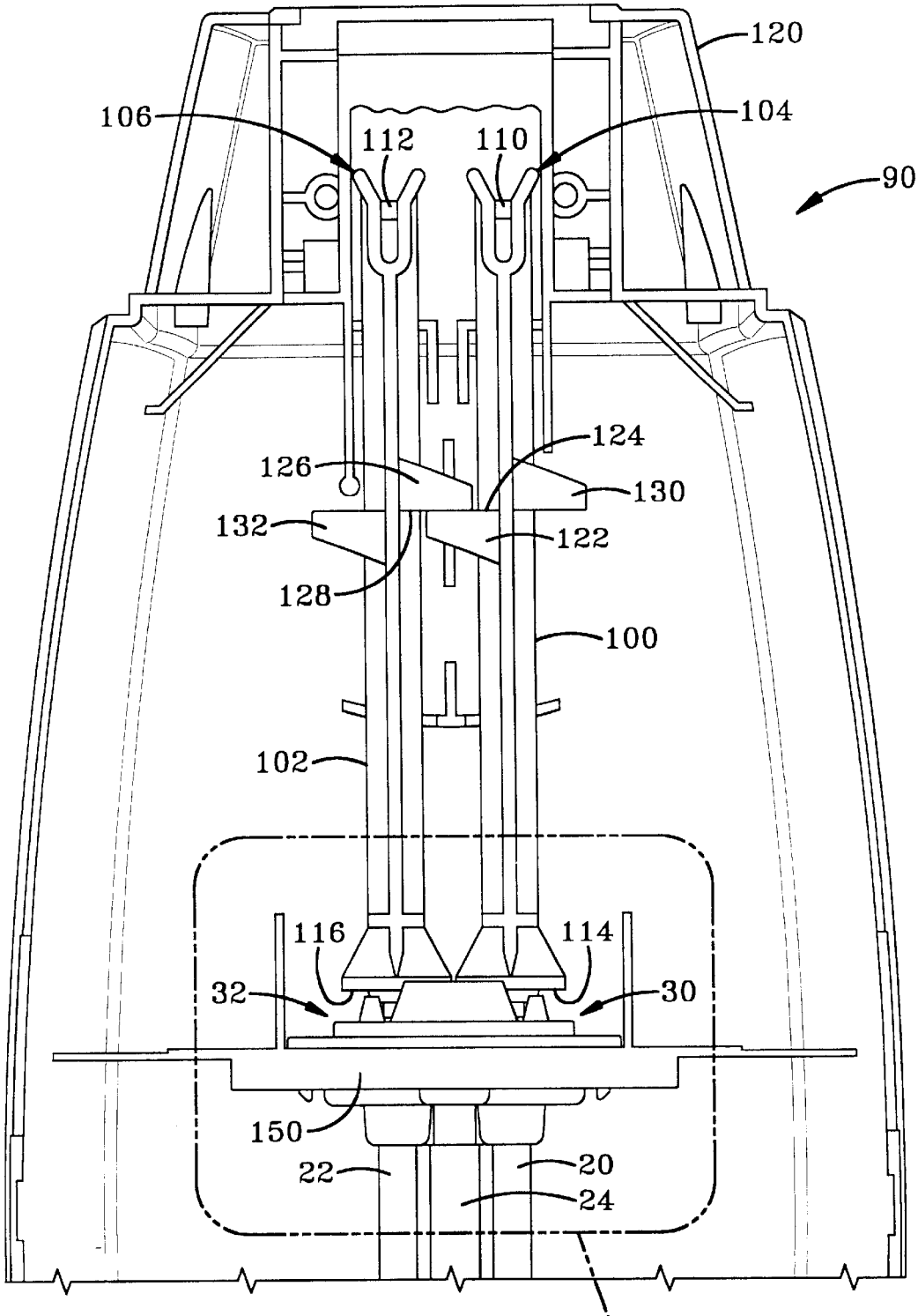
FIG. 4 is a front view of a lower handle assembly of a carpet extractor according to the present invention with the recovery tank and supply tank removed therefrom to expose the cleaning liquid supply system.

Referring now to FIGS. 2A, 2B, 3A and 3B, the first and second actuating rods are formed by first and second upper control rods 50,52 and first and second lower control rods 100,102 (see FIG. 4). Only the upper control rods are illustrated in FIGS. 2A–3B. A resilient hook 60 and 62, see FIGS. 2A and 3A, is formed on the top end of each of the first and second upper control rods. The hooks on the first and second control rods conveniently snap onto pins 64 and 66 integrally formed with the trigger 34 and the thumb-button 40, respectively, and thereby securely capture the pins between the hooks and an opposing upper surface on the top ends of the upper control rods. The lower end of each upper control rod is bifurcated, see FIGS. 2B and 3B, and thereby forms a forked shaped snap connector 68, 69 on the lower end of each of the upper control rod 50,52 for connection to the lower control rods in a manner to be discussed in more detail below. Only one snap connector 68 is visible in FIG. 2B.

The trigger 34 has pivot pins 71 that extend out from either side of the trigger. The pivot pins are rotatably received in recesses formed in the inner surface of the upper handle 75, thereby pivotally mounting the trigger in the upper handle. A resilient spring finger 73, only visible in FIG. 2A, is integrally molded as a part of the trigger. The spring finger engages the inner surface of the upper handle and biases the trigger into its undepressed position. The thumb button 40 is reciprocally received in a channel formed by the walls 76, 77, 78, see FIGS. 2A and 3A, of the upper handle. An S-shaped leaf spring 79, only visible in FIG. 3A, is integrally molded as a resilient part of the thumb button. The leaf spring 79 is received in a pocket formed by walls 81 that are molded as an integral part of the upper handle 75. The leaf spring biases the thumb button into its undepressed position.

As illustrated in FIGS. 2A and 2B, tabs 70, 72, and 74 protrude from the front and rear of each the upper control rods 9 and contact the inner surface of the outer wall of the upper handle 75 for locating and guiding the upper control rods within the handle. The upper handle has guide walls 76, 78, and 80 formed therein, as illustrated in FIG. 3A, that lie closely adjacent to the upper portions of the upper control rods 50, 52 to aid in locating and guiding the upper control rods in the upper handle. A ledge 83 (see FIG. 2A) is provided in the upper handle. The ledge engages a shoulder 85 formed on each of the upper control rods 50, 52 to limit upward travel of the upper control rods relative to the upper handle 75.

The lower handle assembly 90 is illustrated in FIG. 4. The lower end of the lower handle is pivotally attached to the foot of the carpet extractor upon trunnions, not shown, extending from either side of the lower end of the lower handle in a conventional manner. First and second lower control rods 100 and 102 are mounted in the lower handle for vertical reciprocal motion therein. Each of the lower control rods has a flared, bifurcated upper end 104, 106. A connecting pin 110, 112 extends across the opening in the bifurcated upper ends of the lower control rods. The lower ends of the lower control rods have flat actuating surfaces 114, 116 that contact the first 30 and second 32 valves for selectively opening the first and second valves. When the first and second valves are opened, cleaning liquid from the supply tank 8 travels through the first 20 and second 22 supply tubes to the distributor 10 (not shown in FIG. 4) under the force of gravity.

The upper end of the lower handle 90 has a tapered portion 120 that is telescopically received in the lower end of the upper handle. Two screws, not shown, extend through the upper handle, through the lower handle and are secured by two nuts, not shown, to securely attach the upper handle assembly to the lower handle assembly. When the upper handle is secured to the lower handle, the bifurcated lower ends 68 and 69 of the upper control rods are located immediately above the connecting pins 110 and 112 on the lower control rods. The bifurcated lower ends of the upper control rods are then forced down over and snapped onto the connecting pins 110 and 112 by depressing the main trigger 34 and the thumb button. Thus, the first 50 and second 52 upper control rods are connected to the first 100 and second 102 lower control rods for actuating the valves via the trigger 34 and thumb button 40 located in the hand grip 36.

The first lower control rod 100 has a flange 122 extending out from the side thereof with an upward facing contact surface 124. The second lower control rod 102 has a flange 126 extending outward therefrom that has a downward facing contact surface 128. The flange 128 on the second control rod is located immediately above the flange 124 on the first lower control rod. When an operator presses the thumb-button 40, the lower control rod moves down to open the second valve 32, and the contact surface 128 on the second control rod engages the contact surface 124 on first lower control rod, whereby the first control rod is moved with the second control rod for simultaneously opening the first and second valves. The first and second control rods are illustrated in FIG. 4 as each having an upwardly facing flange on a first side thereof and a downwardly facing flange on an opposite side thereof. The flanges 130 and 132, on each lower control rod that extend away from the other lower rod, serve no purpose and are provided merely so that each of the two lower control rods are identical. By providing identical first and second lower control rods, a single mold may be used to mold both the first and second control rods.

Figure 5:
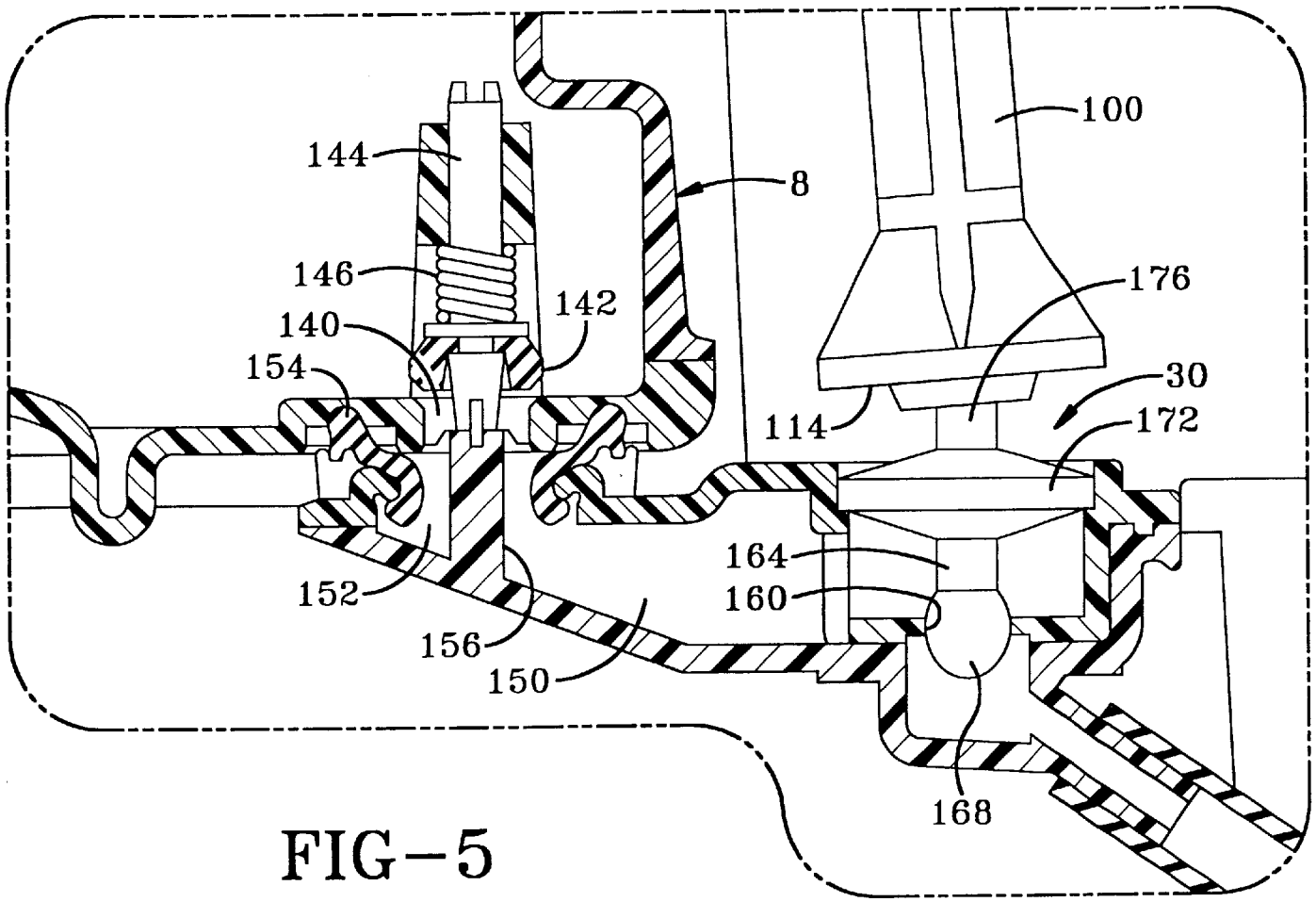
FIG. 5 is a cross-sectional view of the fluid reservoir and first valve.
Figure 6:
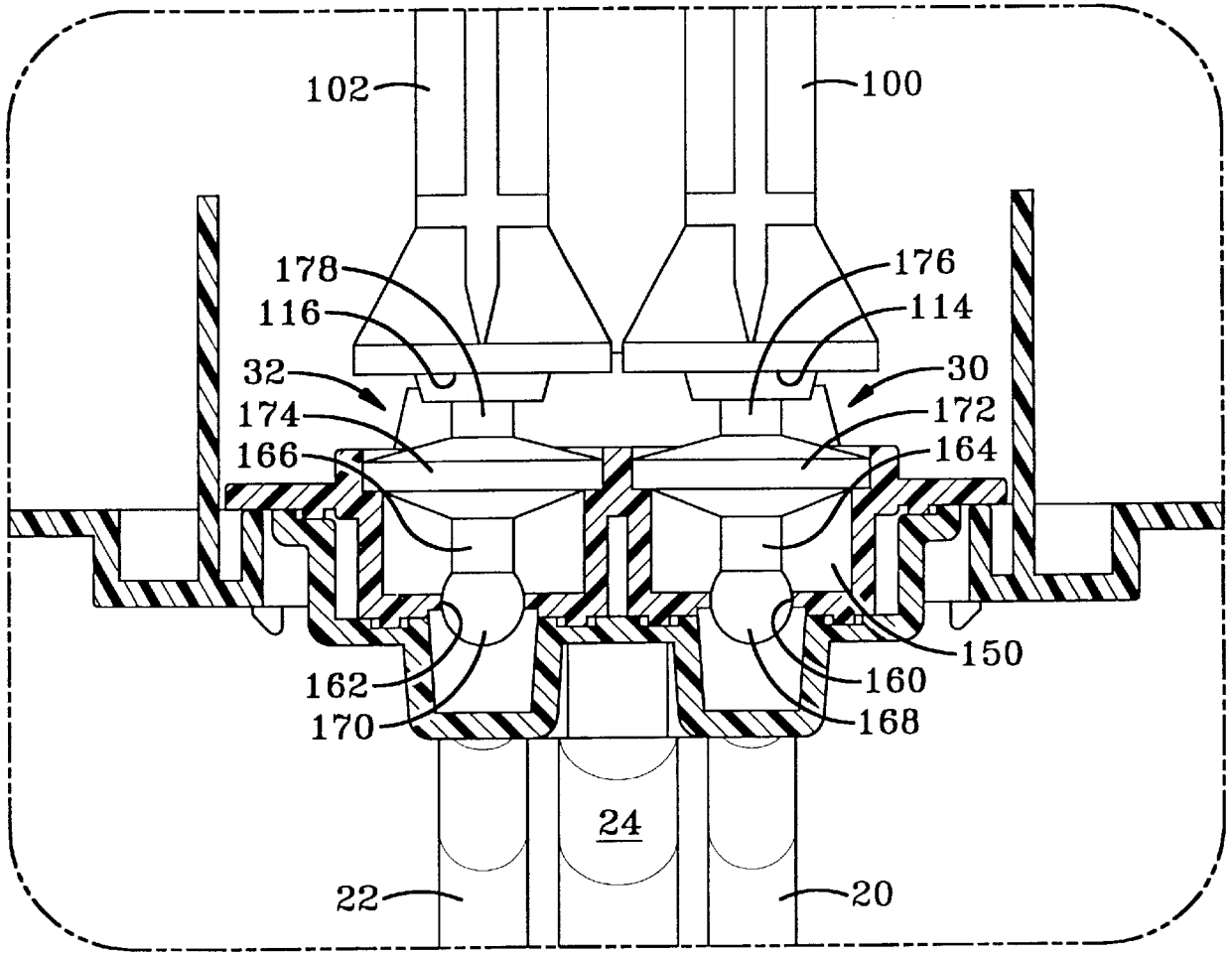
FIG. 6 is a cross-sectional view of the valves according to the present invention.

Referring now to FIGS. 5 and 6, the supply tank 8 includes an outlet opening 140 in the bottom of the tank. A resilient valve 142 mounted on a valve stem 144 is biased by a spring 146 into a closed position in which the valve seals the outlet opening. When the supply tank is mounted to the handle assembly as illustrated in FIGS. 1 and 5, the supply tank 8 communicates with the first 30 and second 32 valves by way of a liquid reservoir 150. The reservoir includes an inlet opening 152 having a resilient peripheral lip seal 154 that engages and seals against the bottom of the supply tank 8 around the outlet opening 140 of the supply tank and around the inside of the reservoir inlet opening. A pin 156 extends up through the center of the reservoir inlet 152. When the supply tank is mounted to the extractor, the pin 156 contacts the valve stem 144 and moves the valve 142 against the spring 146 for opening the outlet 140 of the supply tank. Cleaning liquid then runs under the force of gravity through the outlet of the supply tank and fills the reservoir 150.

The reservoir 150 communicates with the first 20 and second 22 supply tubes by way of first 160 and second 162 valve openings, only one of which is illustrated in FIG. 5. The valve openings are normally sealed closed by the first and second valves. The first and second valves are preferably resilient umbrella shaped valves having valve stems 164, 166 with bulbous heads 168, 170. The bulbous heads are normally seated in the valve openings 160 and 162 by the natural resilience of disc or umbrella shaped portions 172 and 174 of the valves. Flat topped heads 176 and 178 are located on the top of each valve. The heads are engaged by the flat lower ends 114 and 116 of the first 100 and second 102 lower control rods. When an operator depresses the main trigger 34 or the thumb button 40, the corresponding control rods move down relative the handle and the lower end of the corresponding lower control rod presses the head of the corresponding valve down. When the head on the valve is pressed down, the umbrella shaped portion 172, 174 of the valve yields and the stem 164, 166 moves down such that the bulbous head 168, 170 is unseated from the valve opening 160, 162. Cleaning liquid then flows under the force of gravity through the valve opening and through the corresponding supply tube to the distributor. No valve is located in the third supply tube 24. The third supply tube always provides fluid communication between the reservoir 150 and the liquid pump 26.

Figure 7:
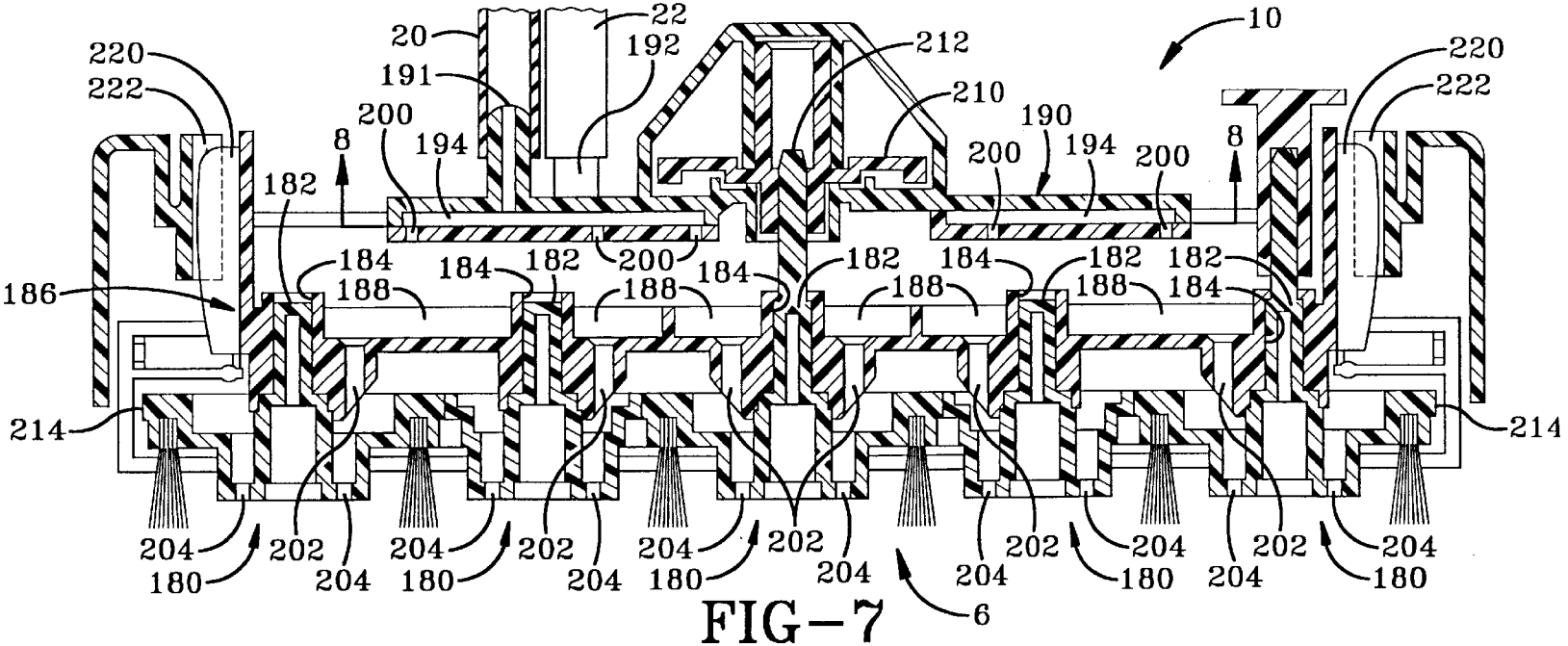
FIG. 7 is a cross-sectional view of the cleaning solution distributor according to the present invention.
Figure 8:
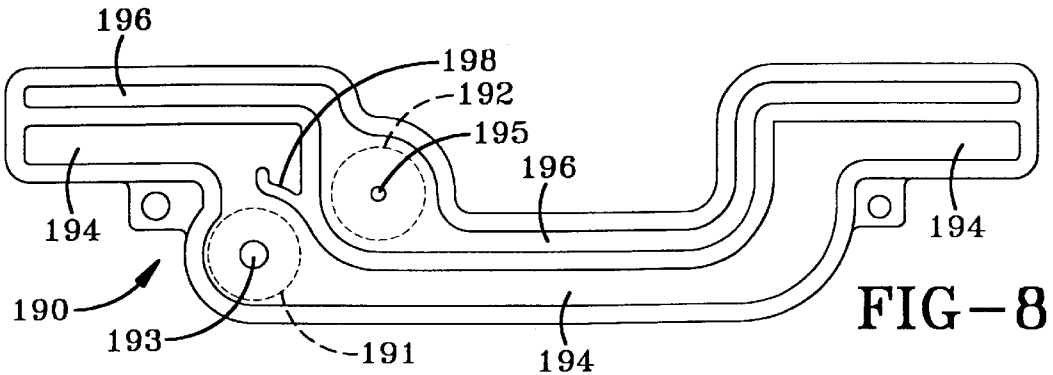
FIG. 8 is a cross-section of the fluid distribution manifold taken along line 8—8 in FIG. 7.

The cleaning solution distributor 10 is illustrated in FIGS. 7 and 8. The distributor is substantially the same as the distributor disclosed in commonly owned U.S. Pat. No. 5,867,857 issued to Crouser et al. The preferred distributor includes a plurality of vertical axis scrub brushes 180. Each scrub brush has a vertically extending axle 182 extending therefrom that is rotatably received in a vertically extending opening 184 in a brush support bar 186. The top of the brush support bar is recessed and defines a cleaning liquid distribution trough 188 defined by a plurality of pockets. A fluid distribution manifold 190 is located above the cleaning liquid distribution trough. The first and second cleaning liquid supply tubes 20, 22 are attached to first 191 and second 192 nipples extending upward from the cleaning solution manifold. The first nipple communicates the first supply tube with a first manifold channel 194. The second supply tube communicates with a second cleaning solution supply channel 196, not visible in FIG. 7, located in the manifold via the second nipple. Each of the first and second channels contain a plurality of liquid discharge openings 200 in the lower wall thereof, through which cleaning liquid flows into the cleaning distribution trough 188. The distribution trough in turn has a plurality of distribution orifices 202 through which cleaning liquid flows into the interior of the hub of each of the rotating scrub brushes 180. The hub of each rotating scrub brush has a plurality of distribution openings 204 through which the solution flows and is deposited onto the floor surface being cleaned. By distributing the cleaning solution into the center of each brush, the cleaning solution is efficiently and evenly spread upon and scrubbed into the carpet by the rotating scrub brushes.

The scrub brushes are preferably driven by an air-powered turbine, not shown. The turbine drives an output gear 210 that receives a post 212 extending up from one of the rotating brushes 180. Each of the rotating brushes has gear teeth 214 extending therefrom that engage the teeth on the adjacent brushes, whereby all of the brushes are geared together and are driven by the turbine. The turbine does not form a part of the present invention and is not described in detail herein.

The brush support bar 186 is preferably mounted to the foot of the carpet extractor by vertically extending rails 220 extending up from either end of the support bar. The rails are received in vertically extending slides 222 formed in the foot 4 of the carpet extractor. With this construction, the brushes may move vertically upon the floor surface relative to the foot the carpet extractor, as described in further detail in co-owned, U.S. Pat. No. 6,009,593.

As can best be seen in FIG. 8, the first supply channel 194 in the manifold has a larger cross-sectional area than the second supply channel 196 in the distribution manifold 190. Likewise, the first nipple 191 connecting the first supply tube 20 to the manifold has a larger internal diameter that the second nipple 192 attaching the second supply tube 20 to the manifold. The internal diameters 193, 195 of the first and second nipples on the manifold, the cross-sectional area of the supply channels 194, 196, and the internal diameters of the discharge openings 200 are sized to control the rate of flow of cleaning liquid from the supply reservoir to the brushes, under the force of gravity, through the first and second supply tubes, through the distributor and to the brushes. A vane 198 is provided in the first supply channel 194 to balance the flow of cleaning liquid to the left and right halves of the channel.

The distribution system is preferably designed such that a flow of approximately 0.24 gallons of cleaning liquid is provided through the first supply tube when the main trigger is depressed. When the thumb button 40 is depressed along with the main trigger, an additional flow of cleaning solution of approximately 0.12 gallons per minute is supplied to the distributor via the second supply tube, for a total flow of 0.36 gallons per minute.

The preferred flow rates are obtained by forming the first nipple 191 on the manifold 190 with an internal diameter of 0.100 inches. The second nipple has an internal diameter of 0.200 inches. The discharge openings 200 in the first channel 194 preferably have internal diameters of 0.080 inches and the discharge openings in the second channel 196 preferably have internal diameters of 0.060 inches. The inlet side and the outlet side of smaller discharge openings in the second distribution channel are preferably tapered, to facilitate the flow of liquid through the openings. It will be appreciated that the exact dimensions of the discharge openings, the supply channels, and the nipples on the manifold required to provide the desired flow rates depend greatly upon the configuration of the entire system. For example, the exact dimensions and configuration of the manifold will vary with the height of the supply tank relative the manifold, the length of the supply tubes, the routing of the supply tubes, i.e. the number and sharpness of bends in the tubing, the diameter of the tubing, the configuration of the valves, etc. Furthermore, when any dimension in the entire distribution system is varied, it may have an affect on the flow rate through the manifold. As a result, the exact configuration and dimensions of the manifold will vary greatly depending on the configuration of the entire system. The desired flow rates are achieved by experimentally varying the configuration and dimensions of the manifold until the desired flow rates are obtained, in a manner understood by one of skill in the art.

It will be appreciated that the system may be designed to provide for other flow rates than the preferred flow rates described herein without departed from the present invention. The object of the present invention is to provide for a first normal flow rate of cleaning liquid and a second higher flow rate of cleaning liquid for cleaning heavily soiled areas, whatever these two flow rates may be.

In operation, an operator fills the supply tank 8 with cleaning liquid. The cleaning liquid is preferably cleaning solution that is obtained by filling the supply tank with a predetermined amount of concentrated cleaning detergent and the remainder with water. Although it can be appreciated that the supply tank may be filled with water only, i.e. no detergent, for rinsing a carpet. After filling the supply tank, the supply tank is attached to the handle portion 2 of the extractor. As discussed above, when the tank is mounted to the handle the valve in the bottom of the tank is opened and cleaning liquid flows into and fills the reservoir 150.

An operator then turns the extractor on and, grasping the hand grip 36 on the pivotal upright handle of the carpet extractor, inclines the handle and pulls the main trigger 36, using their first and second fingers, and thereby applies a first normal flow of cleaning liquid upon the carpet or other floor surface being cleaned. The cleaning liquid flows through the first valve 30, the first supply tube 20, and through the cleaning liquid distributor 10 and is scrubbed into the carpet by the vertical axis scrub brushes 180. Soiled liquid is extracted from the carpet by the suction nozzle 12. Should more effective cleaning be required for heavily soiled high-traffic patterns or stains in the carpeting, an operator simultaneously depresses the main trigger 36 and the thumb-button 40, whereby the first 30 and second 32 valves are simultaneously opened for providing a second relatively higher flow of cleaning liquid to the carpet, effectively flushing the soil out of heavily soiled areas.

Should an operator depress only the thumb button 40 when it is desired to obtain the second relatively higher flow of cleaning liquid for high-traffic patterns or stains, the flange 126 on the second lower control rod 102 will engage the flange 122 on the first lower control rod 100. Thus, the first lower control rod will be driven by the second lower control rod and both valves will be opened, regardless of the fact that the operator failed to depress the main trigger. Thus, it is ensured that an operator will obtain the desired higher flow rate, even when only the thumb-button is depressed.

The present invention has been described by way of example using a preferred embodiment. Upon reviewing the detailed description and the appended drawings, various modifications and variations of the preferred embodiment will become apparent to one of ordinary skill in the art. All such obvious modification and variations are intended to be included in the scope of the present invention and of the claims appended hereto.

For example, rather than the preferred plurality of the vertical axis scrub brushes, a single horizontal axis brush roll may be employed for scrubbing the cleaning solution into the carpet. Likewise, it will be readily realized that an electric motor may be employed for driving the brushes in place of the preferred air turbine. One of skill in the art will also recognize that the main motor driving the suction fan may be employed to drive the brushes.

One of skill in the art will also recognize that rather than employing gravity to feed cleaning solution from the supply tank to the manifold, the liquid pump may be used to provide a source of pressurized cleaning solution to the solution distributor, as well as to the hand-tool, not disclosed herein. It will also be recognized that the first and second valves may be located downstream of the pump and that the valves may communicate with spray nozzles as an alternative to the disclosed cleaning solution distributor. In which case, the distribution manifold may include first and second channels that communicate with a spray nozzle or a plurality of spray nozzles. An alternative embodiment may include a first set of spray nozzles that communicate with the first valve and a second set of spray nozzles that communicate with a second valve.

In view of the above, it is intended that the present invention not be limited by the preceding disclosure of a preferred embodiment, but rather be limited only by the appended claims.

What is claimed is:

1. A method of applying cleaning liquid to a surface being cleaned using a wet extraction type carpet cleaning machine comprising the steps of:

a) applying a main flow of cleaning liquid through a first conduit of said carpet cleaning machine on a carpet for normal cleaning; and b) applying a supplemental flow of cleaning liquid through a second conduit of said carpet cleaning machine on a carpet in addition to the application of said main flow of cleaning liquid for cleaning heavily soiled areas.

2. A method according to claim 1 further comprising the step of scrubbing the cleaning liquid into said carpet.

3. A method according to claim 2 including the step of extracting the cleaning liquid from said carpet.

4. A method of applying cleaning liquid to a surface being cleaned using a wet extraction type carpet cleaning machine comprising the steps of:

a) applying a first flow rate of cleaning liquid on a carpet for normal cleaning by depressing a finger button; and b) applying a second flow rate of cleaning liquid, that is greater than said first flow rate, on a carpet for cleaning heavily soiled areas by depressing a thumb button.

5. A method of applying cleaning liquid to a surface being cleaned using a wet extraction type carpet cleaning machine comprising the steps of:

a) applying a first flow rate of cleaning liquid on a carpet for normal cleaning by depressing a finger button; and b) applying a second flow rate of cleaning liquid, that is greater than said first flow rate, on a carpet for cleaning heavily soiled areas by depressing said finger button and simultaneously depressing a thumb button.

6. A method of applying cleaning liquid to a surface being cleaned using a wet extraction type carpet cleaning machine, said wet extraction type carpet cleaning machine includes a floor engaging portion for distributing cleaning liquid onto said carpet, a handle portion pivotally attached to said floor engaging portion, said handle portion having a hand grip, said method further comprising the steps of:

a) applying a first flow rate of cleaning liquid on a carpet for normal cleaning by grasping said hand grip with a hand and depressing a finger button; and b) applying a second flow rate of cleaning liquid, that is greater than said first flow rate, on a carpet for cleaning heavily soiled areas by depressing said finger button and simultaneously depressing a thumb button.

7. A method according to claim 6 wherein said finger button is depressed by an index finger.

8. A method according to claim 6 further comprising the step of moving said floor engaging portion along said carpet upon depressing one of said finger button and said thumb button.

9. A method according to claim 8 further comprising the step of scrubbing the cleaning liquid into said carpet.

10. A method according to claim 9 including the step of extracting said cleaning liquid from said carpet.

* * * * *